United States Patent [19]

Stoppani

[11] 4,407,545

[45] Oct. 4, 1983

[54] MINE SYSTEM

[75] Inventor: Brian R. Stoppani, Doncaster, England

[73] Assignee: Mining Supplies Limited, England

[21] Appl. No.: 197,332

[22] Filed: Oct. 15, 1980

[30] Foreign Application Priority Data

Oct. 19, 1979 [GB] United Kingdom ..... 7936340

[51] Int. Cl.[3] ..... E21C 29/00

[52] U.S. Cl. ..... 299/30; 299/43

[58] Field of Search ..... 299/30, 43, 42

[56] References Cited

U.S. PATENT DOCUMENTS

| | | | |
|---|---|---|---|
| 3,285,015 | 11/1962 | Carnegie et al. . | |
| 3,362,750 | 1/1968 | Carnegie | 299/30 X |
| 3,371,914 | 3/1968 | Weber | 299/43 X |
| 4,068,893 | 1/1978 | Weivich | 299/43 |
| 4,082,361 | 4/1978 | Lanfermann | 299/43 |
| 4,103,974 | 8/1978 | Nowacki | 299/43 |
| 4,367,900 | 1/1983 | Trümper | 299/30 |

FOREIGN PATENT DOCUMENTS

| | | | |
|---|---|---|---|
| 600300 | 3/1978 | U.S.S.R. | 299/30 |

*Primary Examiner*—William F. Pate, III

*Attorney, Agent, or Firm*—King and Liles

[57] ABSTRACT

A mine system comprises at least one mining machine 4 adapted to haul itself, in a reciprocable manner, along a mineral face 3, and a control box 17 housing means to control the various electrical elements of the machine(s) 4, the box 17 being located in a mine roadway 2 at one end of the mineral face 3 along which the machine(s) 4 is reciprocable, and the box 17 being electrically connected to a terminal box 15 housed in a body of the machine(s).

4 Claims, 2 Drawing Figures

MINE SYSTEM

This invention relates to a mine system for effecting mineral mining operations with one or more mineral winning machines, of the shearer or trepanner type, adapted to be reciprocated along a mineral face.

Conventionally, such machines embody at least one electric motor usually serving both for machine haulage purposes and for rotating at least one cutting head. Most machines effect haulage through a mechanical transmission, although hydraulic and electric haulage arrangements are known. It is also conventional for the body of the machine to house the necessary equipment to control the various electrical, hydraulic or mechanical elements of the machine. It will be appreciated that if a coal face is involved, the control box is necessarily located in a hostile environment, being subjected to vibration, shock loading, heat, as well as liquid and solid contaminants and consequently must be designed and constructed to high standards to meet these rigorous service requirements. This leads to relatively costly control boxes as well as awkward maintenance, repair and fault finding in the limited confines along a mineral face.

According to the present invention a mine system comprises at least one mining machine of the shearer or trepanner type adapted to haul itself, in reciprocable manner, along a mineral face, and a control box housing means to control the various electrical elements of the machine(s), the box being located in a mine roadway at one end of the mineral face along which the machine(s) is reciprocable and the box being electrically connected to a terminal box housed in a body of the machine(s).

It will be appreciated that apart from allowing the control box to be constructed to less demanding standards, thereby reducing the initial cost of a control box, the location of the latter in a mine roadway simplifies repair and maintenance procedures. Furthermore, removal of the control box, which necessarily is of significant size, from the machine body enables the overall length and weight of the machine body to be reduced, as the functions and content of the terminal box are such that it can be of relatively small dimensions. Such a location of the control box in a mine roadway consequently promotes a greater service life of the box, as well as less frequent electrical control faults and consequent loss of mineral production.

In circumstances where the mining machine employes an electric haulage system, a transformer would be required and conveniently this is also located, with the control box, in the mine roadway.

The control box, and any transformer, may be mounted either on a stage loader conveyor conventionally located in a mine roadway, the stage loader advancing, or retreating, with the mineral face, or alternatively on its own support frame.

Figure 1:
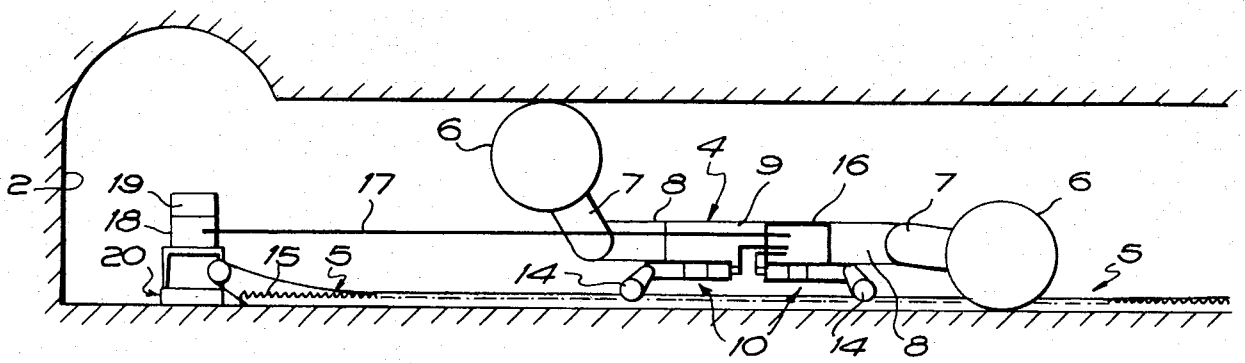
Figure 2:
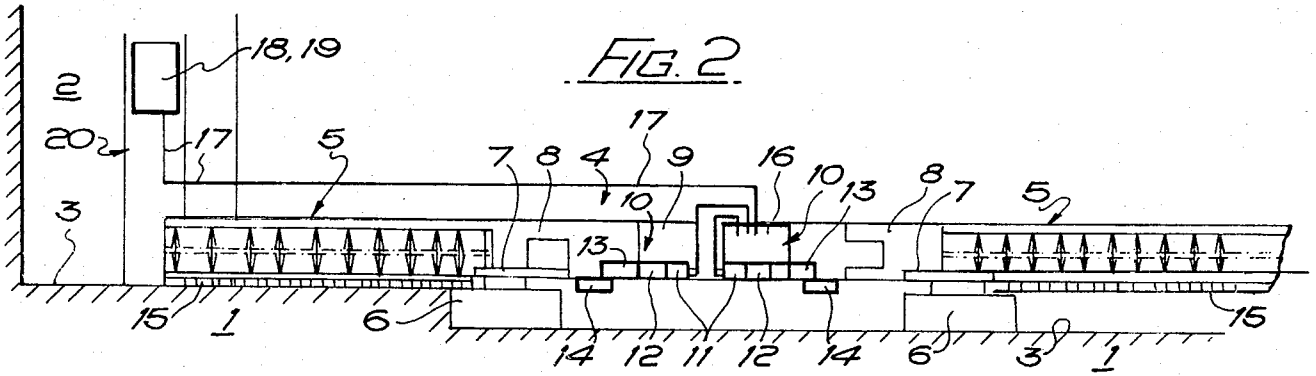

The invention will now be described in greater detail, by way of example, with reference to the accompanying drawings, in which:

FIG. 1 is a diagrammatic view, from the face side, of a mine system in accordance with the invention; and FIG. 2 is a plan view of FIG. 1.

In the drawings, a longwall mineral seam is indicated at 1, with a pair of parellel roadways 2 (one only shown) located at each end of the seam 1. The seam 1 has a face 3 which is won by a longwall shearer 4 reciprocally mounted on, and guided by, an armoured scraper chain conveyor 5 extending along the face 3. The shearer 4 illustrated is in fact a double-ended ranging drum shearer comprising, at each end, a pick-carrying rotary cutting disc 6 rotatably carried at one end of an arm 7 pivotally attached to a gearhead 8 of the shearer 4. The latter further comprises a power module 9 housing an electric motor for driving the discs 6 through suitable speed reduction gearing. The shearer hauls itself to and fro along the conveyor 5 by means of a pair of spaced apart haulage units 10 each comprising a variable speed electric motor 11, e.g. of the a.c. type, a brake unit 12, e.g. of the multi-disc type, and a speed reduction gearbox 13, the latter terminating in a drive sprocket 14 in engagement with a rack 15 carried by and extending along the conveyor 5. Interposed between the power module 9 and one gearhead 8 is terminal box 16 connected by flexible electric cabling 17 to a control box 18 located in the roadway 2. Also in the roadway 2 is a transformer 19 which, together with the control box 18 is mounted on a conventional stage loader conveyor 20 adapted to receive mineral from the face conveyor 5.

What I claim is:

1. A mine system comprising at least one mining machine of the shearer or trepanner type adapted to haul itself, in a reciprocal manner, along a mineral face, a mine roadway located at one end of said mineral face, conveyor means extending along said mineral face to guide said mining machine and to transport the mineral to the roadway, rack means attached to said conveyor and extending longitudinally therealong, a self-contained haulage unit carried by said machine and including at least one variable speed electric motor, a haulage sprocket coupled to said motor for engaging said rack means, a control box for said haulage unit located in said roadway and means for electrically connecting the same to said machine, a terminal box housed in said machine to receive said connecting means, and electrical coupling means between said terminal box and said motor, whereby said self-contained haulage unit and in particular the supply of electrical power to said electric motor of said haulage unit is controlled through said roadway located control box.

2. A mine system as claimed in claim 1 comprising a stage loader conveyor located in said roadway, with said control box mounted on said stage loader conveyor.

3. A mine system as claimed in claim 1, wherein is further provided power transformer means located adjacent said control box to provide electric power through said connecting means to said haulage unit.

4. A mine system as claimed in claim 1 wherein said self-contained haulage unit further includes a second motor carried by said machine, and electrically coupled to said terminal box and a haulage sprocket coupled to said second motor and engaging said rack means, whereby to assist in driving said machine.

* * * * *